US009159284B2

(12) United States Patent
Park et al.

(10) Patent No.: US 9,159,284 B2
(45) Date of Patent: Oct. 13, 2015

(54) LIQUID CRYSTAL DISPLAY DEVICE USING CORRECTED MOVING PICTURE DATA

(75) Inventors: Ji Eun Park, Seoul (KR); Myung Woo Lee, Cheonan-si (KR); Jun hee Moon, Suwon-si (KR); Joo Hyung Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 386 days.

(21) Appl. No.: 13/370,343

(22) Filed: Feb. 10, 2012

(65) Prior Publication Data

US 2013/0076769 A1 Mar. 28, 2013

(30) Foreign Application Priority Data

Sep. 26, 2011 (KR) ..... 10-2011-0097085

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2320/0252* (2013.01); *G09G 2320/064* (2013.01); *G09G 2320/103* (2013.01); *G09G 2340/0435* (2013.01); *G09G 2340/16* (2013.01)

(58) Field of Classification Search
CPC ..... G09G 3/3426
USPC ..... 345/102, 87
See application file for complete search history.

(56) References Cited

U.S. PATENT DOCUMENTS

| | | | | |
|---|---|---|---|---|
| 2005/0078069 | A1* | 4/2005 | Aiba et al. | 345/87 |
| 2005/0237316 | A1* | 10/2005 | Huang et al. | 345/204 |
| 2007/0285382 | A1* | 12/2007 | Feng | 345/102 |
| 2008/0122813 | A1* | 5/2008 | Kim et al. | 345/204 |
| 2009/0009509 | A1* | 1/2009 | Tagami | 345/214 |
| 2009/0237338 | A1* | 9/2009 | Sumi | 345/89 |
| 2009/0244112 | A1* | 10/2009 | Jung et al. | 345/690 |
| 2010/0020110 | A1* | 1/2010 | Yamato | 345/90 |

FOREIGN PATENT DOCUMENTS

| | | | | |
|---|---|---|---|---|
| JP | 2008033107 | A * | 2/2008 | G09G 3/36 |
| KR | 10-2007-0080020 | A | 8/2007 | |
| KR | 10-2009-0066078 | A | 6/2009 | |
| KR | 10-2009-0102083 | A | 9/2009 | |
| KR | 10-2012-0067729 | A | 6/2012 | |

* cited by examiner

*Primary Examiner* — Adam J Snyder
(74) *Attorney, Agent, or Firm* — Lee & Morse, P.C.

(57) ABSTRACT

A liquid crystal display device includes a liquid crystal panel including a plurality of signal lines, a liquid crystal panel driving unit configured to provide a driving voltage to the plurality of signal lines, an image data judging unit configured to judge whether input image data is still image data or moving picture data, an image data correcting unit configured to correct moving picture data to output corrected moving picture to the liquid crystal panel driving unit, a plurality of light sources configured to provide a light to the liquid crystal panel, and a light source driving unit configured to detect a display region having a motion value larger than a reference value from among an image of which frame data is displayed, based on a comparison of current frame data of the moving picture data with previous frame data of the moving picture data.

12 Claims, 6 Drawing Sheets

LIQUID CRYSTAL DISPLAY DEVICE USING CORRECTED MOVING PICTURE DATA

CROSS-REFERENCE TO RELATED APPLICATION

This application claims the benefits, under 35 U.S.C. §119, of Korean Patent Application No. 10-2011-0097085 filed Sep. 26, 2011, the entirety of which is incorporated by reference herein.

BACKGROUND

1. Field

Embodiments relate to a liquid crystal display device, and more particularly, relate to a liquid crystal display device capable of improving the quality of a moving picture.

2. Description of the Related Art

A liquid crystal display device may be formed of two substrates and a liquid crystal layer interposed between the substrates. The liquid crystal display device may display a desired image by controlling the strength of an electric field being applied to the liquid crystal layer and a transmittance of light penetrating the liquid crystal layer. As the liquid crystal device is widely used as a computer display device as well as a television display device, there may be a need for displaying a moving picture.

SUMMARY

An embodiment is directed to a liquid crystal display device, including a liquid crystal panel configured to display an image, the liquid crystal panel including a plurality of signal lines, a liquid crystal panel driving unit configured to provide a driving voltage to the plurality of signal lines, an image data judging unit configured to judge whether input image data is still image data or moving picture data, an image data correcting unit configured to correct moving picture data and output corrected moving picture to the liquid crystal panel driving unit, a plurality of light sources configured to provide light to the liquid crystal panel, and a light source driving unit configured to detect a display region having a motion value larger than a reference value from among an image of which frame data is displayed, based on a comparison of current frame data of the moving picture data with previous frame data of the moving picture data. The light source driving unit may be further configured to respectively control a part of the plurality of light sources corresponding to the detected display region and a remaining part of the plurality of light sources, based on the detected display region.

The image data judging unit may provide the input image data to the liquid crystal panel driving unit and the light source driving unit when the input image data is judged to be still image data.

The image data correcting unit may include a first frame memory configured to store current frame data of the moving picture data, a second frame memory configured to store previous frame data of the moving picture data, an overdriving unit configured to output overdriving data corrected according to the current frame data and the previous frame data read from the first frame memory and the second frame memory, and a replace unit configured to generate replace data based on the current frame data and the previous frame data read from the first frame memory and the second frame memory, the replace unit being configured to provide the replace data to the second frame memory.

A driving frequency of the liquid crystal display device when the input image data is still image data may be half a driving frequency of the liquid crystal display device when the input image data is moving picture data.

A number of frames per second of moving picture data provided to the first and second frame memories may be half a number of frames per second of moving picture data output from the first and second frame memories.

The second frame memory may include a compression unit configured to compress the previous frame data and the replace data before the previous frame data and the replace data are stored, a storage unit configured to store the compressed previous frame data and replace data, and a restoration unit configured to restore the compressed previous frame data and replace data output from the storage unit, and to output restored compressed previous frame data and replace data.

The overdriving unit may include a first comparator configured to compare the current frame data and the previous frame data, and output a first comparison signal including information associated with a voltage difference between the current frame data and the previous frame data, a first lookup table configured to store overdriving voltage data corresponding to the voltage difference, and a first correcting unit configured to read overdriving data corresponding to the first comparison signal from the first lookup table.

The replace unit may include a second comparator configured to compare the current frame data and the previous frame data, and output a second comparison signal including information associated with a voltage difference between the current frame data and the previous frame data, a second lookup table configured to store replace voltage data corresponding to the voltage difference, and a second correcting unit configured to read replace data corresponding to the second comparison signal from the second lookup table.

If the input image data is still image data, the light source driving unit may control the plurality of light sources based on the still image data.

The light source driving unit may include a motion region detector configured to compare the current frame data and the previous frame data to detect a first display region having the motion value larger than the reference value and a second display region having a motion value smaller than the reference value, from among an image where the current and previous frame data are to be displayed, the motion region detector outputting a motion region detecting signal as a detection result, a light source power controller configured to output a first dimming signal controlling a power of a first portion of the plurality of light sources corresponding to the first display region, a second dimming signal controlling a power of a second portion of the plurality of light sources corresponding to the second display region, and a luminance signal, based on the motion region detecting signal, and a light source current controller configured to output a current control signal controlling currents of the first portion of the plurality of light sources and the second portion of the plurality of light sources, based on the motion region detecting signal and the luminance signal.

A duty ratio of the first dimming signal may be smaller than that of the second dimming signal.

The first portion of the plurality of light sources may perform a blinking operation.

The light source current controller may supply the first portion of the plurality of light sources with a larger current than the light source current controller supplies to the second portion of the plurality of light sources.

Another embodiment is directed to a liquid crystal display device, including a liquid crystal panel configured to display an image, the liquid crystal panel including a plurality of signal lines, a liquid crystal panel driving unit configured to provide a driving voltage to the plurality of signal lines, an image data correcting unit configured to correct moving picture data and output corrected moving picture to the liquid crystal panel driving unit, a plurality of light sources configured to provide light to the liquid crystal panel, and a light source driving unit configured to detect a region having a motion value larger than a reference value from among an image of which frame data is displayed, based on a comparison of current frame data of the moving picture data with previous frame data of the moving picture data. The light source driving unit may be further configured to respectively control a part of the plurality of light sources corresponding to the detected region and a remaining part of the plurality of light sources.

Input image data may be provided to a data driver of the liquid crystal panel driving unit when the input image data is still image data.

The image data correcting unit may include a frame memory configured to store current frame data of the moving picture data, an overdriving unit configured to output overdriving data corrected according to the current frame data and the previous frame data read from the frame memory, and a replace unit configured to generate replace data based on the current frame data and the previous frame data read from the frame memory, the replace unit being configured to provide replace data to the frame memory.

A driving frequency of the liquid crystal display device when the input image data is still image data may be identical to a driving frequency of the liquid crystal display device when the input image data is moving picture data.

A number of frames per second of moving picture data provided to the frame memory may be identical to a number of frames per second of moving picture data output from the frame memory.

When the input image data is still image data, the light source driving unit may control the plurality of light sources based on the still image data.

The light source driving unit may include a motion region detector configured to compare the current frame data and the previous frame data to detect a first display region having the motion value larger than the reference value and a second display region having a motion value smaller than the reference value, from among an image where the current and previous frame data are to be displayed, the motion region detector outputting a motion region detecting signal as a detection result, a light source power controller configured to output a first dimming signal controlling a power of a first portion of the plurality of light sources corresponding to the first display region, a second dimming signal controlling a power of a second portion of the plurality of light sources corresponding to the second display region, and a luminance signal, based on the motion region detecting signal, and a light source current controller configured to output a current control signal controlling currents of the first portion of the plurality of light sources and the second portion of the plurality of light sources, based on the motion region detecting signal and the luminance signal.

BRIEF DESCRIPTION OF THE DRAWINGS

The above and other features will become apparent from the following description with reference to the following figures, wherein like reference numerals refer to like parts throughout the various figures unless otherwise specified, and wherein.

DETAILED DESCRIPTION

Figure 1:
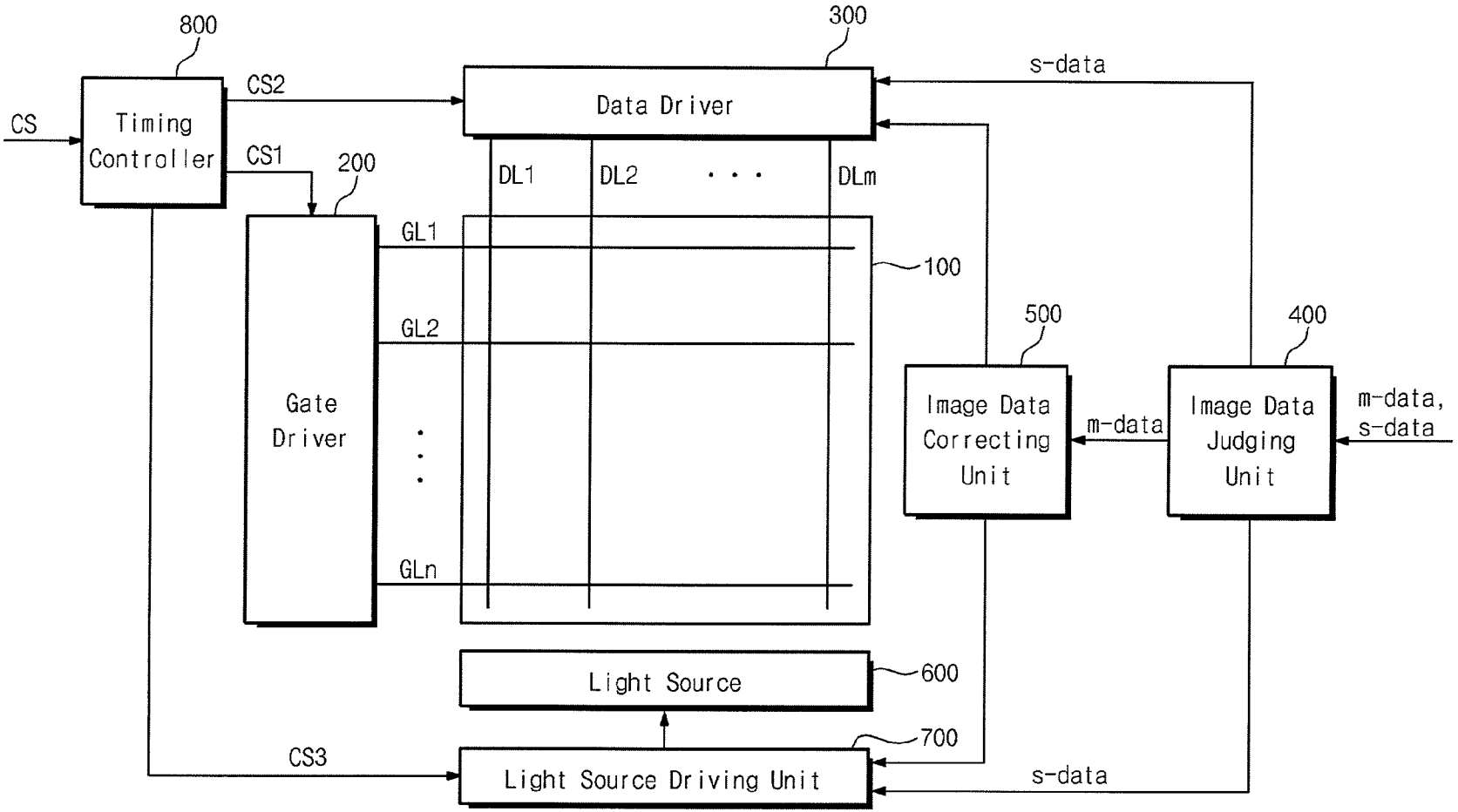
FIG. 1 is a block diagram schematically illustrating a liquid crystal display device according to an example embodiment.

FIG. 1 is a block diagram schematically illustrating a liquid crystal display device according to an example embodiment.

A liquid crystal display device according to an example embodiment may include a liquid crystal panel 100 having a plurality of signal lines and displaying an image; a liquid crystal panel driving unit providing a driving voltage to the plurality of signal lines; an image data judging unit 400 judging whether image data is still image data or moving picture data; an image data correcting unit 500 correcting moving picture data; a light source 600 providing a light to the liquid crystal panel 100; and a light source driving unit 700 driving the light source 600.

The liquid crystal panel 100 may include a plurality of gate lines GL1 through GLn each supplied with a gate voltage and a plurality of data lines DL1 through DLm each supplied with a data voltage. Pixel regions of the liquid crystal panel 100 may be defined in a matrix form by the plurality of gate lines GL1 through GLn and the plurality of data lines DL1 through DLm. Pixels may be provided at the pixel regions, respectively. Although not shown in FIG. 1, each pixel may be formed of a thin film transistor, a liquid crystal capacitor, and a storage capacitor.

In an example embodiment, the liquid crystal panel 100 may include a lower display substrate, an upper display substrate disposed to be opposite to the lower display substrate, and a liquid crystal layer interposed between the lower display substrate and the upper display substrate.

The plurality of gate lines GL1 through GLn, the plurality of data lines DL1 through DLm, the thin film transistor, and a pixel electrode being a first electrode of the liquid crystal capacitor may be formed at the lower display substrate. The thin film transistor may supply a data voltage to the pixel electrode in response to a gate voltage.

A common electrode being a second electrode of the liquid crystal capacitor may be formed at the upper display substrate, and a common voltage may be applied to the common electrode. A liquid crystal layer interposed between the pixel electrode and the common electrode may act as a dielectric substance. The liquid crystal capacitor may charge a voltage corresponding to a potential difference between a data voltage and the common voltage.

The liquid crystal panel driving unit may include a gate driver 200, a data driver 300, and a timing controller 800.

The gate driver 200 may be connected to the plurality of gate lines GL1 through GLn of the liquid crystal panel 100, and may supply a gate voltage to the plurality of gate lines GL1 through GLn, respectively.

The data driver 300 may be connected to the plurality of data lines DL1 through DLm, and may supply a data voltage to the plurality of data lines DL1 through DLm, respectively.

The timing controller 800 may receive a control signal CS to output timing-controlled control signals CS1, CS2, and CS3 (hereinafter, referred to as first through third control signals). The first control signal CS1 may be supplied to the gate driver 200 to control an operation of the gate driver 200. The first control signal CS1 may include a vertical start signal indicating a start of an operation of the gate driver 200, a gate clock signal determining an output point of time of a gate voltage, an output enable signal determining an on pulse width of a gate voltage, and the like. The second control signal CS2 may be supplied to the data driver 300 to control an operation of the data driver 300. The second control signal CS2 may include a horizontal start signal indicating a start of an operation of the data driver 300, an inversion signal inverting a polarity of a data voltage, an output start signal determining an output point of time when a data voltage is output from the data driver, and the like. The third control signal CS3 may be supplied to the light source driving unit 700 to control an operation of the light source driving unit 700. The third control signal CS3 may include a horizontal synchronization signal.

The image data judging unit 400 may be supplied with image data m-data and s-data from an external device. The image data judging unit 400 may judge whether input image data is still image data s-data or moving picture data m-data. For example, in the event that the input image data is judged to be still image data s-data, the image data judging unit 400 may provide the input image data, that is, the still image data s-data, to the data driver 300 and the light source driving unit 700. In the event that the input image data is judged to be moving picture data m-data, the image data judging unit 400 may provide the input image data, that is, the moving picture data m-data, to the image data correcting unit 500.

Correction of the input image data may be made according to whether input image data is still image data s-data or moving picture data m-data. This may reduce or help minimize increases in power consumption.

The image data correcting unit 500 may receive moving picture data m-data. The image data correcting unit 500 may correct the moving picture data m-data and provide the corrected moving picture data to the data driver 300.

The light source 600 may be disposed at a lower part of the liquid crystal panel 100 to provide a light to the liquid crystal panel 100. The light source 600 may be plural. The light source 600 may include a light emitting diode, which may be a point light source, or a Cold Cathode Fluorescent Lamp (CCFL), which may be a linear light source.

The light source driving unit 700 may receive moving picture data m-data. The light source driving unit 700 may compare data of a current frame of the moving picture data with data of a previous frame of the moving picture data. The light source driving unit 700 may detect a display region having a motion larger than a reference from an image of which the moving picture data m-data is displayed, and may control a part of the light source 600 (corresponding to the detected display region) and the remaining part of the light source 600, based on the detected display region.

A driving frequency of a liquid crystal device supplied with still image data may be half a driving frequency of the liquid crystal device supplied with moving picture data. For example, when a driving frequency of a liquid crystal device supplied with still image data is 60 Hz, a driving frequency of the liquid crystal device supplied with moving picture data may be 120 Hz.

Figure 2:
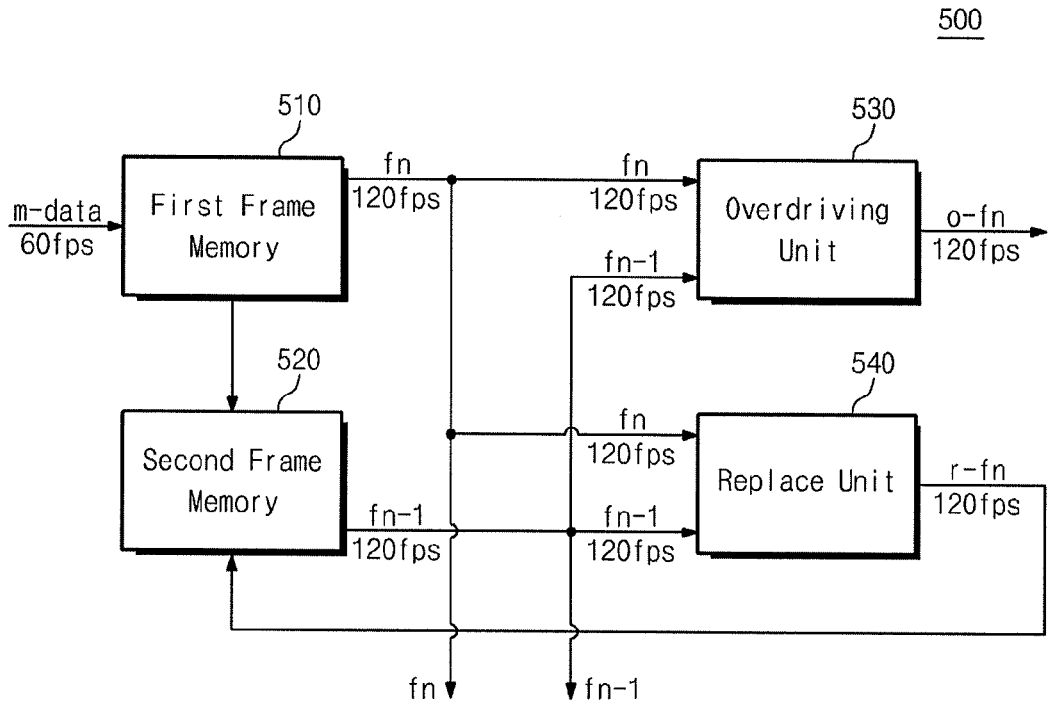
FIG. 2 is a block diagram schematically illustrating an image data correcting unit in FIG. 1.

FIG. 2 is a block diagram schematically illustrating an example of the image data correcting unit 500 in FIG. 1.

Referring to FIG. 2, the image data correcting unit 500 may include a first frame memory 510, a second frame memory 520, an overdriving unit 530, and a replace unit 540.

Current frame data fn of input moving picture data m-data may be stored in the first frame memory 510. The current frame data fn stored in the first frame memory 510 may be provided to the second frame memory 520 at a next frame, and next frame data may be stored in the first frame memory 510.

Previous frame data fn−1 of input moving picture data m-data may be stored in the second frame memory 520. As will be more fully described later, the previous frame data fn−1 may be replaced with replace data r-fn.

The overdriving unit 530 may be supplied with the current frame data fn stored in the first frame memory 510 and the previous frame data fn−1 stored in the second frame memory 520. The overdriving unit 530 may read the current frame data fn from the first frame memory 510 and the previous frame data fn−1 from the second frame memory 520, respectively. The overdriving unit 530 may output overdriving data o-fn based on the read frame data fn and fn−1.

The replace unit 540 may be supplied with the current frame data fn stored in the first frame memory 510 and the previous frame data fn−1 stored in the second frame memory 520. The replace unit 540 may read the current frame data fn from the first frame memory 510 and the previous frame data fn−1 from the second frame memory 520, respectively. The replace unit 540 may output replace data r-fn based on the read frame data fn and fn−1. The place data r-fn may be transferred to the second frame memory 520.

The replace data r-fn may be stored in the second frame memory 520. At this time, the previous frame data fn−1 stored in the second frame memory 520 may be replaced with the replace data r-fn.

The image data correcting unit 500 may be configured such that nth frame data fn of input moving picture data m-data is stored in the first frame memory 510 and (n−1)th frame data fn−1 thereof is stored in the second frame memory 520. The image data correcting unit 500 may output nth overdriving data o-fn and nth replace data r-fn based on the nth frame data fn and the (n−1)th frame data fn−1.

The image data correcting unit 500 may be configured such that (n+1)th frame data fn+1 of the moving picture data m-data is stored in the first frame memory 510 and the nth replace data r-fn is stored in the second frame memory 520. The image data correcting unit 500 may output (n+1)th overdriving data o-fn+1 and (n+1)th replace data r-fn based on the (n+1)th frame data fn+1 and the nth replace data r-fn.

A response speed of liquid crystal may be improved by outputting overdriving data and replace data whenever moving picture frame data is input.

Figure 3:
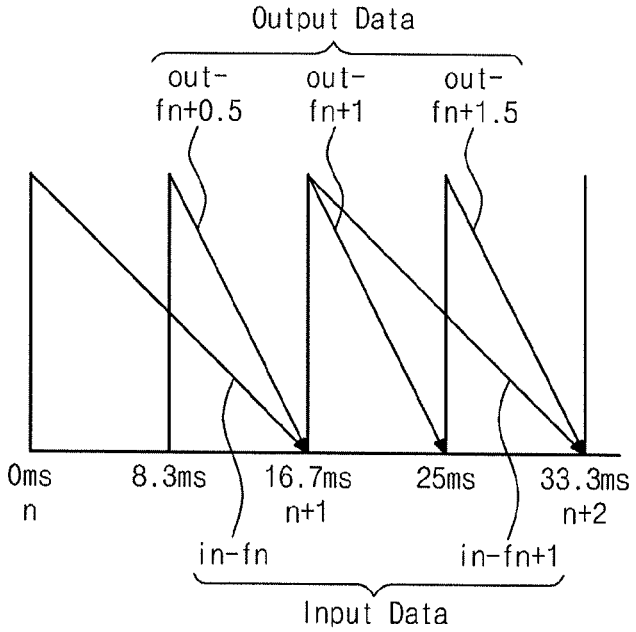
FIG. 3 is a diagram for describing moving picture data input to and output from a first frame memory.

FIG. 3 is a diagram for describing moving picture data input to and output from the first frame memory 510.

Referring to FIG. 3, the number of frames per second (fps) of moving picture data m-data provided to the first frame memory 510 may be half the number of frames per second of moving picture data output from first and second frame memories 510 and 520.

For example, moving picture data m-data may be provided to the first frame memory in 60 fps and nth frame data in-fn of the moving picture data m-data may be stored in the first frame memory 510 during a first frame (0 ms through 16.7 ms). The nth frame data in-fn stored in the first frame memory 510 may be output after a delay of half a frame, that is, from an (n+0.5)th frame. That is, the nth frame data in-fn stored in the first frame memory 510 may be output during half a frame 8.3 ms through 16.7 ms. Data (out-fn+0.5) output from the (n+0.5)th frame may be interpolated with data input during a period between 8.3 ms and 16.7 ms, based on data, input during a period between 0 ms and 8.3 ms, from among the nth frame data in-fn provided to the first frame memory 510. A resultant value may be output during a period between 8.3 ms and 16.7 ms.

Data (out-fn+1) output from the (n+1)th frame may be interpolated with data, input during a period between 16.7 ms and 25 ms, from among the (n+1)th frame data (in-fn+1) provided to the first frame memory 510, based on data, input during a period between 8.3 ms and 16.7 ms, from among the nth frame data in-fn provided to the first frame memory 510. A resultant value may be output during a period between 16.7 ms and 25 ms.

Accordingly, moving picture data output from the first frame memory 520 may have a rate of 120 fps.

Figure 4:
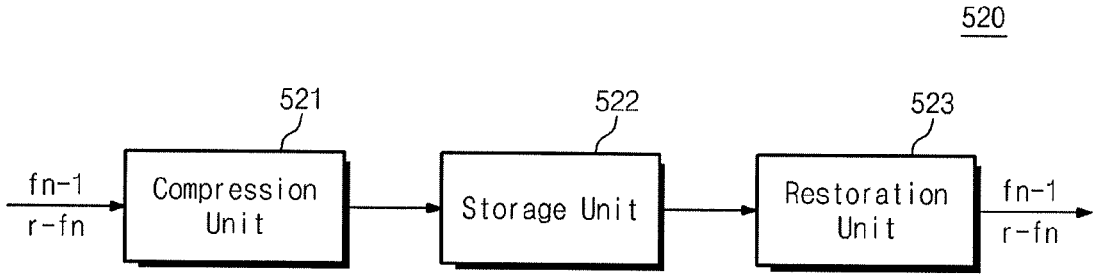
FIG. 4 is a block diagram schematically illustrating a second frame memory in FIG. 2.

FIG. 4 is a block diagram schematically illustrating the second frame memory 520 in FIG. 2.

Referring to FIG. 4, the second frame memory 520 may include a compression unit 521, a storage unit 522, and a restoration unit 523.

Before previous frame data fn−1 and replace data r-fn are stored in the second frame memory 520, the compression unit 521 may compress the previous frame data fn−1 and the replace data r-fn, respectively. The compressed previous frame data and the compressed replace data may be stored in the storage unit 522.

The storage unit 522 may store the compressed previous frame data and the compressed replace data.

Before the compressed previous frame data and the compressed replace data are output, the restoration unit 523 may restore the compressed previous frame data and the compressed replace data. The restored previous frame data fn−1 and the restored replace data r-fn may be provided to the overdriving unit 530 and the replace unit 540 in FIG. 2.

Figure 5:
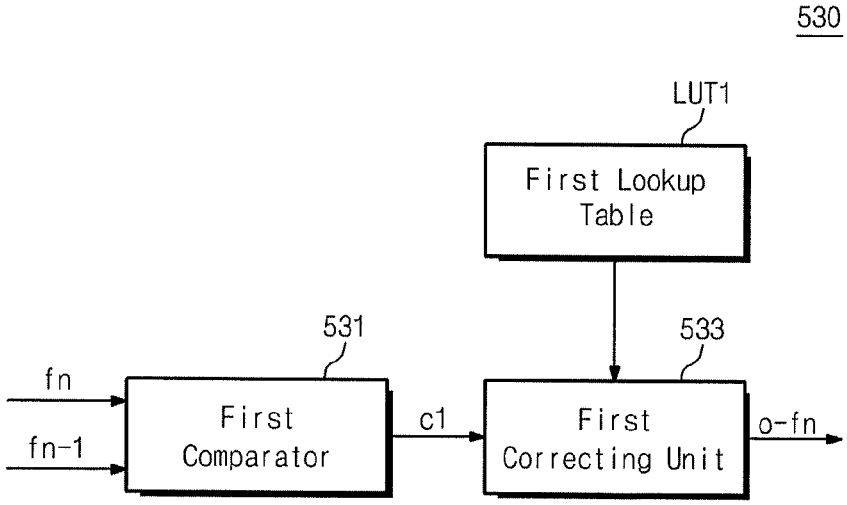
FIG. 5 is a block diagram schematically illustrating an overdriving unit in FIG. 2.

FIG. 5 is a block diagram schematically illustrating the overdriving unit 530 in FIG. 2.

Referring to FIG. 5, the overdriving unit 530 may include a first comparator 531, a first lookup table LUT1, and a first correcting unit 533.

The first comparator 531 may be supplied with current frame data fn and previous frame data fn−1 of moving picture data m-data from the first and second frame memories 510 and 520. The first comparator 531 may compare the current frame data fn and the previous frame data fn−1, and may output a first comparison signal c1. The first comparison signal c1 may include information on a voltage difference between the current frame data fn and the previous frame data fn−1.

The first lookup table LUT1 may store overdriving voltage data corresponding to the voltage difference between the current frame data fn and the previous frame data fn−1.

The first correcting unit 533 may read overdriving data o-fn corresponding to the first comparison signal c1 from the first lookup table LUT1. For example, when a voltage value of the previous frame data fn−1 is smaller in size than a voltage value of the current frame data fn, the overdriving data o-fn may have a voltage value of a data larger than that of the current frame data fn. When a voltage value of the previous frame data fn−1 is larger in size than a voltage value of the current frame data fn, the overdriving data o-fn may have a voltage value of a data smaller than that of the current frame data fn.

The response speed of liquid crystal may be improved by outputting the overdriving data o-fn to the data driver 300 and applying an overdriven data voltage to a data line of a liquid crystal panel 100 via the data driver 300.

Figure 6:
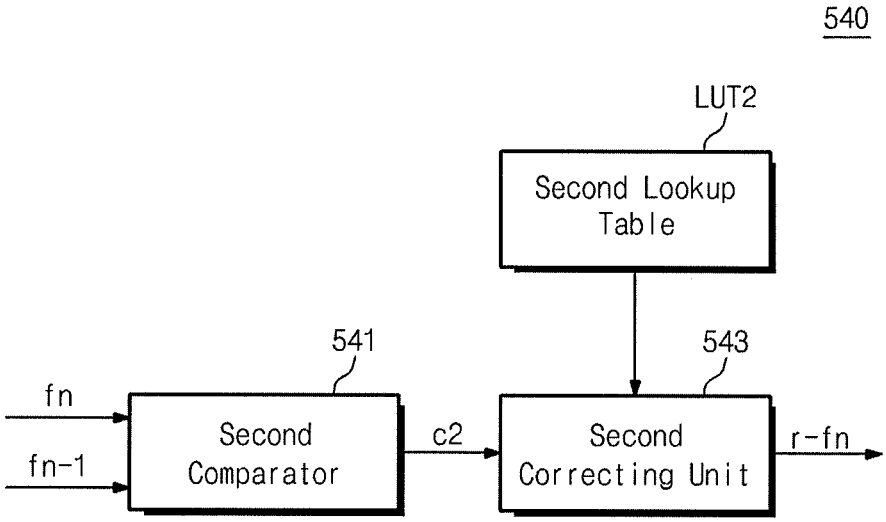
FIG. 6 is a block diagram schematically illustrating a replace unit in FIG. 2.

FIG. 6 is a block diagram schematically illustrating the replace unit 540 in FIG. 2.

Referring to FIG. 6, the replace unit 540 may include a second comparator 541, a second lookup table LUT2, and a second correcting unit 543.

The second comparator 541 may be supplied with current frame data fn and previous frame data fn−1 of moving picture data m-data from the first and second frame memories 510 and 520. The second comparator 541 may compare the current frame data fn and the previous frame data fn−1, and may output a second comparison signal c2. The second comparison signal c2 may include information on a voltage difference between the current frame data fn and the previous frame data fn−1.

The second lookup table LUT2 may store replace voltage data corresponding to the voltage difference between the current frame data fn and the previous frame data fn−1.

The second correcting unit 543 may read replace data r-fn corresponding to the second comparison signal c2 from the second lookup table LUT2. The replace data r-fn may have a value obtained by interpolating the current frame data fn and the previous frame data fn−1. The replace data r-fn may be sent to the second frame memory 520 to replace the previous frame data fn−1. Since the replace data r-fn becomes new previous frame data every frame, this may help reduce a difference of overdriving data o-fn due to the previous frame data fn−1.

Figure 7:
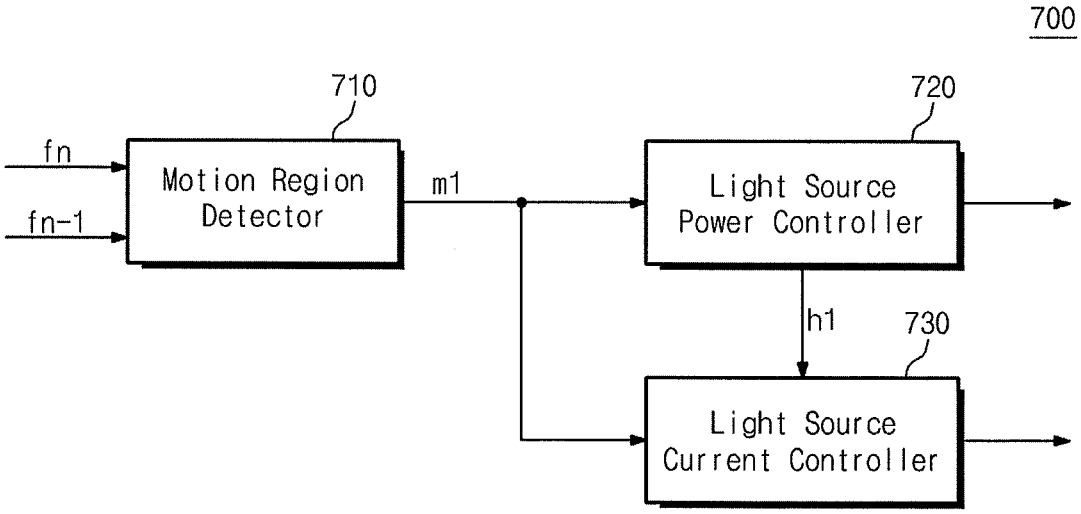
FIG. 7 is a block diagram schematically illustrating a light source driving unit in FIG. 1.

FIG. 7 is a block diagram schematically illustrating aspects of the light source driving unit 700 in FIG. 1.

Referring to FIG. 7, a light source driving unit 700 may include a motion region detector 710, a light source power controller 720, and a light source current controller 730.

The motion region detector 710 may receive current frame data fn and previous frame data fn−1 of moving picture data. The motion region detector 710 may compare the current frame data fn and the previous frame data fn−1, and may detect a first display region having a motion value larger than a reference value and a second display region having a motion value smaller than the reference value, from among an image of which the frame data fn and fn−1 are to be displayed. The motion region detector 710 may output a motion region detecting signal m1 including information associated with the first and second display regions.

The light source power controller 720 may control a power of a first portion of a light source 600, e.g., a first subset of a plurality of LEDs, corresponding to the first display region and a power of a second portion of the light source 600, e.g., a second subset of the plurality of LEDs, corresponding to the second display region, based on the motion region detecting signal m1. The light source power controller 720 may provide a first dimming signal to the first portion of the light source 600 and a second dimming signal to the second portion of the light source 600. A duty ratio of the first dimming signal may be lower than that of the second dimming signal.

The first portion of the light source 600 may perform a blinking operation. At this time, the light source power controller 720 may control a blinking period by controlling a duty ratio of the first dimming signal. A luminance of the first display region corresponding to the first portion of the light source 600 may be lowered via the blinking operation of the first portion of the light source 600.

The light source power controller 720 may output a luminance signal h1 including information associated with a luminance of each of the first and second display regions.

The light source power controller 720 may not perform a blinking operation with respect to the second display region where a motion value is smaller than the reference value.

It may be possible to reduce motion blur of an image and to display an image more clearly via the light source power controller 720. Further, power consumption may be reduced by selectively performing a blinking operation with respect to the first portion of the light source 600.

The light source current controller 730 may be supplied with the motion region detecting signal m1 and the luminance signal h1. The light source current controller 730 may control currents supplied to the first and second portions of the light source 600 based on the motion region detecting signal m1 and the luminance signal h1.

Under the control of the light source current controller 730, a current supplied to the first portion of the light source 600 may be greater than that supplied to the second portion of the light source 600. The light source current controller 730 may compensate a luminance reduced due to the blinking operation carried out at the first portion of the light source 600.

Figure 8:
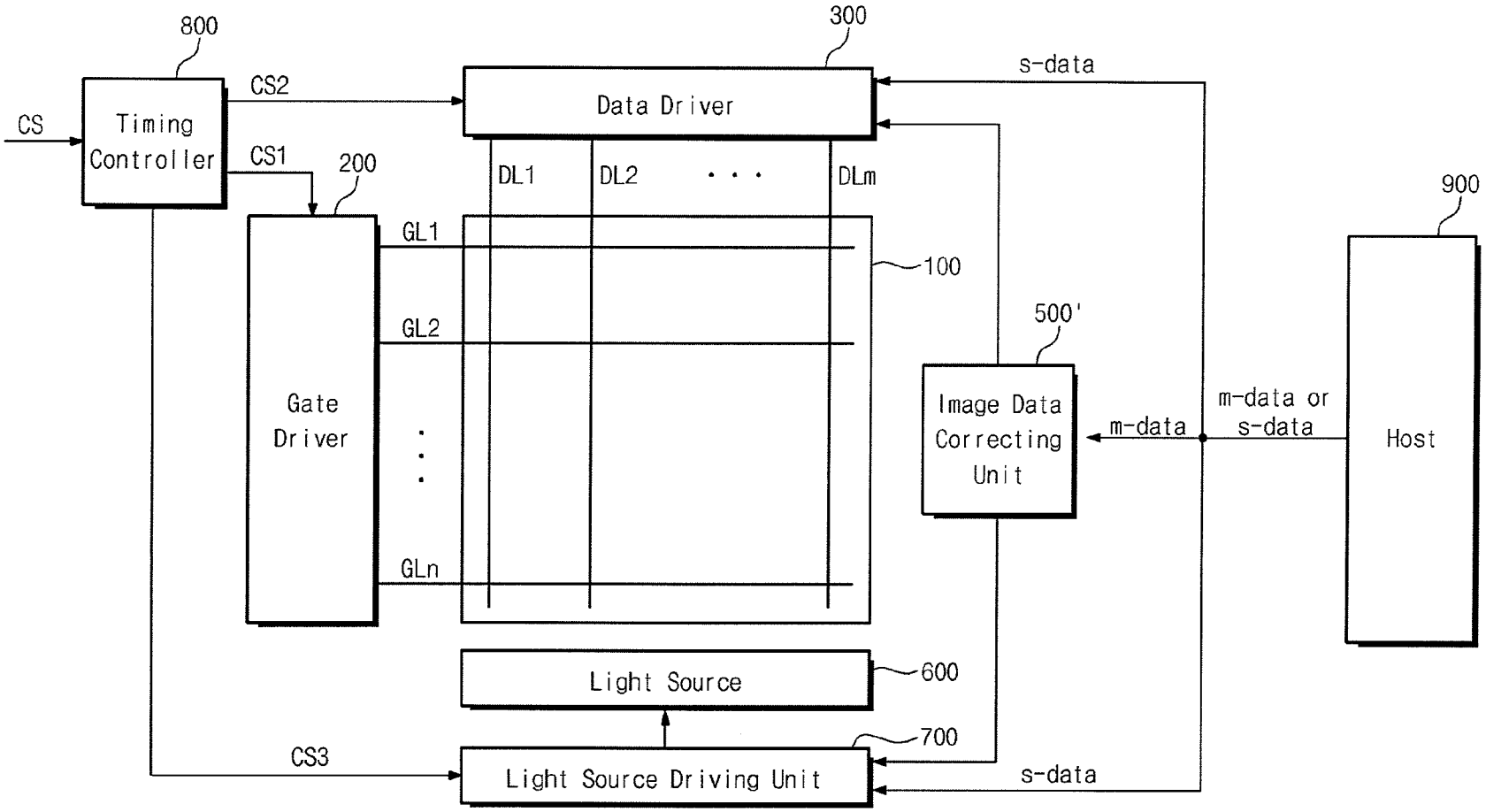
FIG. 8 is a block diagram schematically illustrating a liquid crystal display device according to another example embodiment.

FIG. 8 is a block diagram schematically illustrating a liquid crystal display device according to another example embodiment.

Referring to FIG. 8, a liquid crystal display device may include the liquid crystal panel 100 displaying images, the liquid crystal panel driving unit, an image data correcting unit 500', the light source 600, and the light source driving unit 700. The liquid crystal panel driving unit may include the gate driver 200, the data driver 300, and the timing controller 800.

In FIG. 8, constituent elements which are substantially identical to those in FIG. 1 may be marked by the same reference numerals. Below, a difference between liquid crystal display devices in FIGS. 1 and 8 will be described.

A host 900 provided outside the liquid crystal display device according to the present example embodiment may judge whether image data is still image data s-data or moving picture data m-data.

The host 900 may switch an interface when the image data is changed to the moving picture data from the still image data, or when the image data is changed to the still image data from the moving picture data. The host 900 may output one of the moving picture data m-data and the still image data s-data.

In the event that moving picture data m-data is output from the host 900, it may be provided to the image data correcting unit 500'. In the event that still image data s-data is output from the host 900, it may be provided to the data driver 300 and the light source driving unit 700.

The image data correcting unit 500' may be supplied with moving picture data m-data from the host 900. The image data correcting unit 500' may correct the input moving picture data m-data to provide the corrected moving picture data to the data driver 300.

Figure 9:
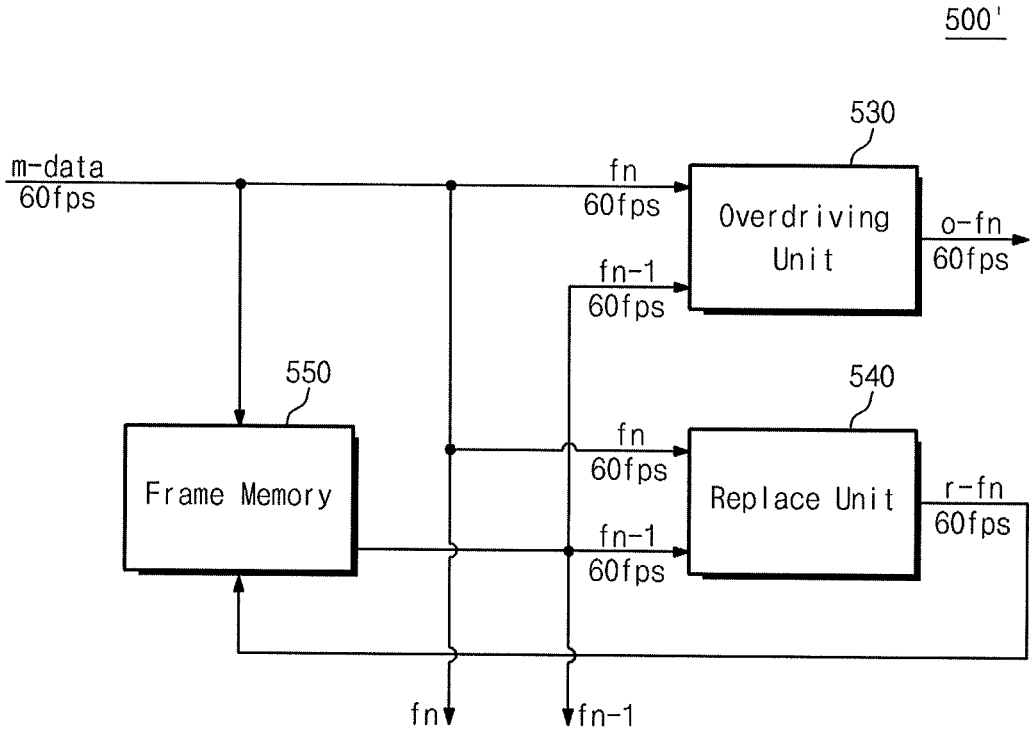
FIG. 9 is a block diagram schematically illustrating an image data correcting unit in FIG. 8.

FIG. 9 is a block diagram schematically illustrating the image data correcting unit 500' in FIG. 8.

In FIG. 9, constituent elements which are substantially identical to those in FIG. 2 may be marked by the same reference numerals.

Referring to FIG. 9, the image data correcting unit 500' may include a frame memory 550, the overdriving unit 530, and the replace unit 540.

Previous frame data fn−1 of moving picture data m-data provided from the host 900 may be stored in the frame memory 550. As will be more fully described below, the previous frame data fn−1 may be replaced with replace data r-fn.

The overdriving unit 530 may be supplied with current frame data fn of the moving picture data m-data and the previous frame data fn−1 stored in the frame memory 550. The current frame data fn may use the moving picture data m-data provided from the host 900.

The overdriving unit 530 may output overdriving data o-fn corrected using the current and previous frame data fn and fn−1.

The replace unit 540 may be supplied with the current frame data fn of the moving picture data m-data and the previous frame data fn−1 stored in the frame memory 550. The current frame data fn may use the moving picture data m-data provided from the host 900. The replace unit 540 may output replace data r-fn using the current frame data fn and the previous frame data fn−1. The replace data r-fn may be sent to the frame memory 550.

The replace data r-fn may be stored in the frame memory 550 to replace the previous frame data fn−1 stored in the frame memory 550.

The image data correcting unit 500 may be configured such that the overdriving unit 530 directly uses the current frame data fn of the moving picture data m-data provided from the host 900. Accordingly, it may be possible to reduce the number of frame memories of the image data correcting unit 500'.

In the case of a liquid crystal display device described in relation to FIGS. 8 and 9, a driving frequency of a liquid crystal device supplied with still image data s-data may be identical to that supplied with moving picture data m-data. For example, when a driving frequency of a liquid crystal device supplied with still image data s-data is 60 Hz, a driving frequency of the liquid crystal device supplied with moving picture data m-data may be 60 Hz.

Further, in the case of a liquid crystal display device described in relation to FIGS. 8 and 9, the number of frames per second of moving picture data m-data provided to a frame memory 550 may be identical to that output from the frame memory 550.

The number of frames per second of moving picture data m-data provided to the frame memory 550 may be, e.g., 60 fps, 120 fps, or 180 fps. Preferably, the number of frames per second of moving picture data m-data provided to the frame memory 550 may be 60 fps. The number of frames per second of moving picture data m-data output from the frame memory 550 may be 60 fps, 120 fps, or 180 fps to correspond to the number of frames per second of moving picture data m-data provided to the frame memory 550. Preferably, the number of frames per second of moving picture data m-data output from the frame memory 550 may be 60 fps.

With the image data correcting unit 500' in FIG. 9, while corrected data is being output, it may be unnecessary to store current frame data in a frame memory. Accordingly, it may be possible to reduce the number of frame memories and to lower production costs of a liquid crystal display device.

By way of summation and review, a response speed of liquid crystal in a liquid crystal display device may be slow, and a hold type operation may be used. This may make present some difficulties when displaying a moving picture using the liquid crystal display device. A liquid crystal display device may use a Dynamic Capacitance Compensation (DCC) technique to implement a rapid response speed of liquid crystal. With the DCC technique, the rapid response speed of the liquid crystal may be implemented by providing a current frame with frame data corrected considering data of the current frame and data of a previous frame. With the DCC technique, however, a target value of frame data corrected according to previous frame data fn−1 and fn−2 may differ. Further, a liquid crystal display device using the DCC technique may use a frame memory for storing frame data, and an increase in the frame memory may cause an increase in production costs of the liquid crystal display device and a decrease in manufacturing productivity. Further, although a response speed of the liquid crystal may be improved, a motion blur due to a characteristic of a hold type display device may be exhibited.

As described above, embodiments may provide a liquid crystal display device that may reduce motion blur of an image and display an image more clearly. Further, power consumption may be reduced.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description.

What is claimed is:

1. A liquid crystal display device, comprising:

a liquid crystal panel configured to display an image, the liquid crystal panel including a plurality of signal lines;

a liquid crystal panel driving unit configured to provide a driving voltage to the plurality of signal lines;

an image data judging unit configured to judge whether input image data is still image data or moving picture data;

an image data correcting unit comprising a first frame memory configured to store current frame data of the moving picture data and a second frame memory configured to store previous frame data of the moving picture data, the image data correcting unit configured to correct moving picture data by using an overdriving data and a replace data and output corrected moving picture data to the liquid crystal panel driving unit, and wherein the current frame data is displayed after the previous frame data;

a plurality of light sources configured to provide light to the liquid crystal panel; and a light source driving unit configured to detect a display region having a motion value larger than a reference value from among an image of which frame data is displayed, based on a comparison of the current frame data of the moving picture data with the previous frame data of the moving picture data, wherein the image data correcting unit is further configured to output the overdriving data and the replace data based on the current frame data and the previous frame data, wherein the previous frame data is replaced with the replace data, wherein a number of frames per second of the moving picture data provided to the first and second frame memories is a half of a number of frames per second of the moving picture data output from the first and second frame memories, wherein the current frame data stored in the first frame memory is output after a delay of half a time during one a frame of the current frame data input to the first frame memory, and wherein the light source driving unit is further configured to respectively control a part of the plurality of light sources corresponding to the detected display region and a remaining part of the plurality of light sources, based on the detected display region.

2. The liquid crystal display device of claim 1, wherein the image data judging unit provides the input image data to the liquid crystal panel driving unit and the light source driving unit when the input image data is judged to be still image data.

3. The liquid crystal display device of claim 2, wherein the image data correcting unit further comprises:

an overdriving unit configured to output overdriving data corrected according to the current frame data and the previous frame data read from the first frame memory and the second frame memory; and a replace unit configured to generate replace data based on the current frame data and the previous frame data read from the first frame memory and the second frame memory, the replace unit being configured to provide the replace data to the second frame memory.

4. The liquid crystal display device of claim 3, wherein a driving frequency of the liquid crystal display device when the input image data is still image data is half a driving frequency of the liquid crystal display device when the input image data is moving picture data.

5. The liquid crystal display device of claim 3, wherein the second frame memory comprises:

a compression unit configured to compress the previous frame data and the replace data before the previous frame data and the replace data are stored;

a storage unit configured to store the compressed previous frame data and replace data; and a restoration unit configured to restore the compressed previous frame data and replace data output from the storage unit, and to output restored compressed previous frame data and replace data.

6. The liquid crystal display device of claim 5, wherein the overdriving unit comprises:

a first comparator configured to compare the current frame data and the previous frame data, and output a first comparison signal including information associated with a voltage difference between the current frame data and the previous frame data;

a first lookup table configured to store overdriving voltage data corresponding to the voltage difference; and a first correcting unit configured to read overdriving data corresponding to the first comparison signal from the first lookup table.

7. The liquid crystal display device of claim 6, wherein the replace unit comprises:

a second comparator configured to compare the current frame data and the previous frame data, and output a second comparison signal including information associated with a voltage difference between the current frame data and the previous frame data;

a second lookup table configured to store replace voltage data corresponding to the voltage difference; and a second correcting unit configured to read replace data corresponding to the second comparison signal from the second lookup table.

8. The liquid crystal display device of claim 3, wherein, if the input image data is still image data, the light source driving unit controls the plurality of light sources based on the still image data.

9. The liquid crystal display device of claim 8, wherein the light source driving unit comprises:

a motion region detector configured to compare the current frame data and the previous frame data to detect a first display region having the motion value larger than the reference value and a second display region having a motion value smaller than the reference value, from among an image where the current and previous frame data are to be displayed, the motion region detector outputting a motion region detecting signal as a detection result;

a light source power controller configured to output a first dimming signal controlling a power of a first portion of the plurality of light sources corresponding to the first display region, a second dimming signal controlling a power of a second portion of the plurality of light sources corresponding to the second display region, and a luminance signal, based on the motion region detecting signal; and a light source current controller configured to output a current control signal controlling currents of the first portion of the plurality of light sources and the second portion of the plurality of light sources, based on the motion region detecting signal and the luminance signal.

10. The liquid crystal display device of claim 9, wherein a duty ratio of the first dimming signal is smaller than that of the second dimming signal.

11. The liquid crystal display device of claim 10, wherein the first portion of the plurality of light sources performs a blinking operation.

12. The liquid crystal display device of claim 10, wherein the light source current controller supplies the first portion of the plurality of light sources with a larger current than the light source current controller supplies to the second portion of the plurality of light sources.

* * * * *